United States Patent [19]

Schidlowski et al.

[11] 3,942,707

[45] Mar. 9, 1976

[54] SHOE BOX CONSTRUCTION

[75] Inventors: Juan Carlos Schidlowski; Stephen F. Walker, both of Denver, Colo.

[73] Assignee: Alan P. McGregor, Denver, Colo.

[22] Filed: Aug. 7, 1974

[21] Appl. No.: 495,333

[52] U.S. Cl. ..... 229/2.5 R; 229/29 M; 220/307; D9/185

[51] Int. Cl.[2] ..... B65D 1/24

[58] Field of Search ..... 229/2.5, 15, 146, 29 M; 206/278, 233, 508, 509; D89/1 R, 1 SC, 1 SR; 220/339, 307; D9/182, 184, 185, 187

[56] References Cited

UNITED STATES PATENTS

| | | | |
|---|---|---|---|
| 1,511,265 | 10/1924 | Chilson | D9/185 X |
| 2,580,982 | 1/1952 | Weiss | 206/233 X |
| 2,600,130 | 6/1952 | Schilling | 229/2.5 |
| 3,603,499 | 9/1971 | Snow | 229/29 M X |
| 3,817,441 | 6/1974 | Jackson | 229/2.5 |
| 3,851,789 | 12/1974 | Case | 220/307 |
| D135,249 | 3/1943 | Naranick | D9/185 |

FOREIGN PATENTS OR APPLICATIONS

| | | | |
|---|---|---|---|
| 568,779 | 6/1958 | Belgium | 206/278 |

*Primary Examiner*—Davis T. Moorhead
*Attorney, Agent, or Firm*—Burton, Crandell & Polumbus

[57] ABSTRACT

A shoe box includes a lower receptacle portion of generally rectangular horizontal cross section having downwardly convergent side walls and end walls so as to be nestable with like receptacles. A hollow partition is disposed internally of the receptacle to serve as a divider between a pair of shoes or the like to eliminate contact between the shoes. The partition opens downwardly through the bottom of the receptacle so as not to inhibit the nesting capabilities of the receptacle. A top member is hingedly connected to the upper edge of the receptacle by a living hinge, and latch means along an opposite edge serves to releasably secure the top member in closed relationship over the open top of the receptacle. The top member has a pair of raised rims along opposite sides thereof so that when the shoe box is closed, a plurality of the boxes can be stacked in a reliable manner and yet can be slid off an underlying container to facilitate easy removal from a storage shelf.

9 Claims, 7 Drawing Figures

SHOE BOX CONSTRUCTION

BACKGROUND OF THE INVENTION

The present invention relates generally to box type containers and more particularly to a box type container adapted to retain footwear.

Box type containers for footwear have not changed appreciably from their inception and consequently have not been updated to take advantage of modern day containerizing techniques. Conventional shoe boxes consist of a lower receptacle with mutually perpendicular side and end walls defining an unobstructed interior portion in which a pair of shoes or the like are positioned and separated by a sheet of tissue paper to prevent damaging frictional contact between the shoes. A lid or top for the box typically has a peripheral down turned flange which fits over the upper edge of the receptacle portion of the box to selectively close the box. The boxes do not have nesting capabilities nor can they be reliably stacked in a closed condition since there are no cooperative means on the box for restraining relative movement when stacked vertically upon each other.

SUMMARY OF THE INVENTION

The shoe box of the present invention includes a lower receptacle portion having a bottom wall and downwardly convergent side walls and end walls. Partition means are positioned interiorally of the receptacle portion of the box so as to separate a pair of shoes or the like retained in the receptacle to eliminate damaging frictional contact between the shoes while in the box. The partition means is hollow and opens downwardly through the bottom of the box so that the receptacle portion of a plurality of like boxes can be nested in stacked relationship for storage of the boxes when they are not in use. Protruding handles are provided at oppostie ends of the receptacle to facilitate removal from shelves and the like and provide an abutment stop for uniform nesting.

A top member is preferably hinged to the receptacle portion of the box along an upper edge thereof so as to be swingable from an open position to a closed position overlying the open top of the receptacle portion. A quick release latch is provided along the opposite upper edge of the receptacle from the hinge to selectively secure the top member in its closed position. The top member has a pair of raised ribs extending along opposite side edges which define a space adapted to seat the lower portion of the receptacle of an adjacent vertically stacked box. The ribs prevent stacked boxes from being slid laterally off each other, but allow the boxes to be easily slid longitudinally off an underlying box so that selected ones of the boxes in a stack of the boxes can be easily removed without detrimentally affecting the stack.

It will be appreciated that the aforementioned features of the box provide distinct advantages over the conventionally used shoe boxes in that the use of tissue paper to separate the shoes is not needed, the boxes can be reliably stacked with shoes therein in a neat vertically oriented stack and the empty boxes can be nested in a compact stack to minimize storage space. Preferably the boxes are made of a synthetic plastic material so that the top member can be hingedly connected to the receptacle portion by a living hinge and the latch can be molded into the top and the receptacle portion in a simple manner. Additionally, if the boxes are made of a plastic material, they can be made in various colors and identifying indicia corresponding to the type and/or style of footwear contained in the box can be embossed or embedded in the end of the box for ready identification by a shoe clerk.

Other objects, advantages and capabilities of the present invention will become more apparent as the description proceeds taken in conjunction with the accompanying drawings.

DESCRIPTION OF THE PREFERRED EMBODIMENT

Figure 1:
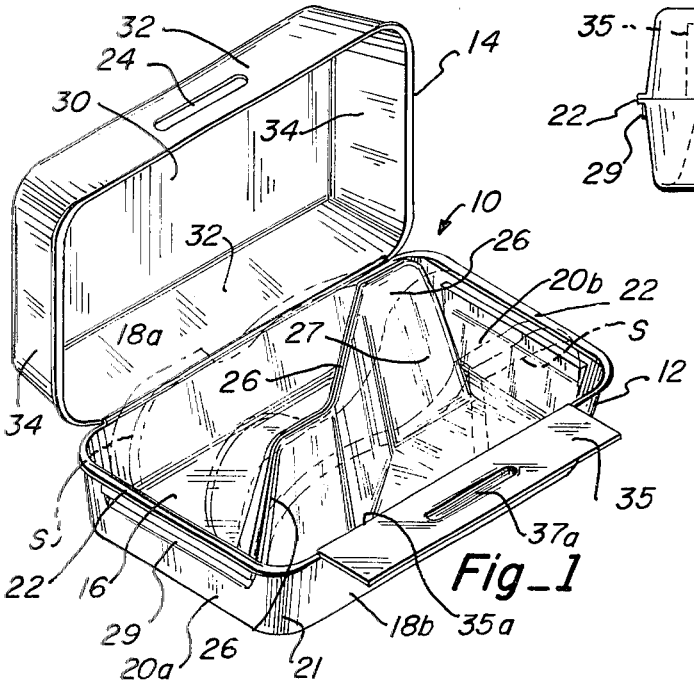
FIG. 1 is a perspective view of the shoe box of the present invention in an open condition.
Figure 2:
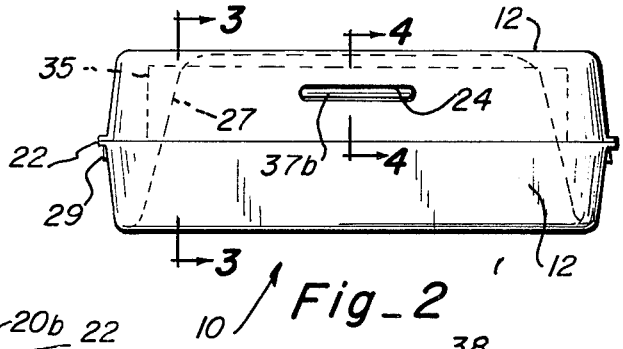
FIG. 2 is a front elevation of the shoe box of FIG. 1 with the box in a closed condition.
Figure 4:
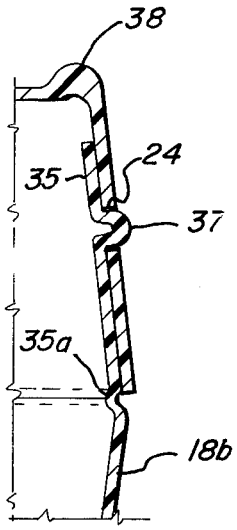
FIG. 4 is a vertical section illustrating the latch for the box of FIG. 1 taken along line 4—4 of FIG. 2.

Referring first to FIG. 1, the shoe box or container 10 of the present invention can be seen to include a lower or receptacle portion 12 and a top member or lid 14 adapted to selectively close the receptacle portion 12. The receptacle portion is seen to have a flat bottom wall 15, downwardly convergent side walls **18*a* and 18*b* and downwardly convergent end walls 20*a* and 20*b* which are integrally interconnected at rounded corners 21. The upper peripheral rim 22 of the receptacle 12 flairs outwardly along most of its extent defining a flange upon which the top member 14** rests.

Figure 6:
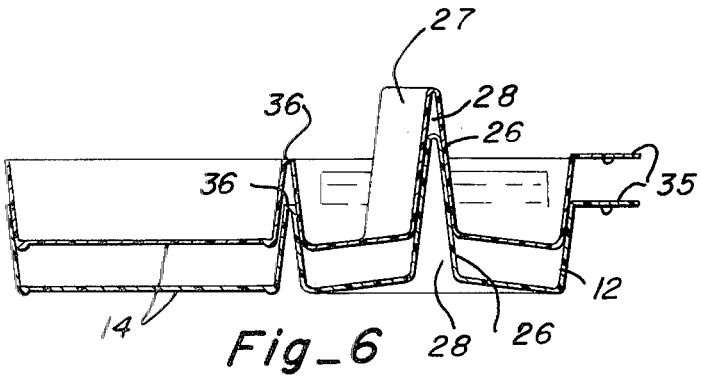
FIG. 6 is a vertical section taken through a nested stack of shoe boxes of the type shown in FIG. 1.
Figure 7:
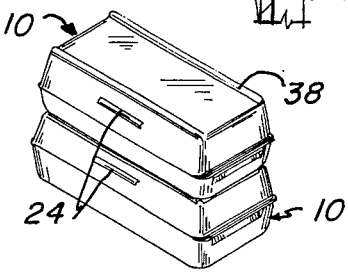
FIG. 7 is a perspective view of a plurality of the shoe boxes of FIG. 1 in a stacked arrangement.

A continuous partition or divider 26 of generally S-shaped longitudinal cross-section is integrally formed within the confines of the receptacle portion 12 and serves to separate shoes S or the like retained in the box to eliminate contact between the shoes. The partition has upwardly convergent sides 27 and is hollow so as to open at 28 through the bottom wall 16 of the receptacle. In this manner it will be appreciated that when the receptacle portion of the box is nested with the receptacle portion of other identical boxes FIG. 6, the partition of an underlying receptacle can protrude into the hollow interior of the associated partition of the overlying receptacle. The partition extends above the upper edge of the receptacle so as to engage or lie in close proximity to top member 14 when the top member is closed over the open top of the receptacle. As best seen in FIG. 1, the partition intersects the opposite end walls **20*a* and 20*b* at locations which are unequally spaced from the side walls 18*a* and 18*b*.**

As best illustrated in FIG. 1, it will be seen that the corners 21 of the box are of thicker construction than the sides and bottom of the box so that these areas are reinforced relative to the remainder of the box and are, therefore, not easily collapsed or damaged in normal use.

At opposite ends of the receptacle 12 and at the upper edges thereof, the end walls protrude outwardly defining a boss 29 (FIG. 5) having a generally vertical portion 29*a* and a lower portion 29*b* which inclines inwardly and upwardly to form a handle which can be gripped by the fingers to facilitate easy removal of a box from a storage shelf or the like. Also, the lower portion 29*b* which inclines inwardly and upwardly to form a handle which can be gripped by the fingers to facilitate easy removal of a box from a storage shelf or the like. Also, the lower portion 29*b* serves as an abuttment stop for the upper edge of the end wall of a lower nested receptacle so the receptacles will nest uniformly. The portion 29*a* of the boss 29 can be used to support an identifying label or the like which could provide a visual display of the style and size of the shoes or the like retained in the box. It will be appreciated that since the boss 29 limits the amount of overlap of nested receptacles, indicia on a label affixed to the boss would assuredly always be visible and unobstructed by a lower nested receptacle.

The top member or lid 14 of the box 10 is seen to have a top wall 30 with a pair of downturned side walls and end walls 32 and 34, respectively with the end walls having out turned flanges 34*a* which abut the rim 22 of the receptacle. The size and configuration of the lower edges of the flanges 32 and 34 are substantially the same as the size and configuration of the upper edge 22 of the receptacle portion of the box. The lower edge of one side wall flange 32 is hingedly connected at 36 to the upper edge of the rear side wall 18*a* of the receptacle 12 so that the top member is freely swingable between an open condition, FIG. 1, and a closed condition, FIG. 3. The unhinged side wall 32 of the top 14 has an elongated horizontal slot 24 therethrough which is adapted to frictionally receive a protruding rib 37 on a flap 35 connected by a hinge 35*a* to the side wall 18*b* of the receptacle. The cooperation of the rib 37 with the slot 24 serves to latch the box in the closed condition of FIG. 3. Preferably, the shoe box is made of a plastic material so that the hinges 35*a* and 36 are in the form of a living hinge as illustrated. In the closed condition, it can be seen in FIG. 3 that the top member 14 and receptacle 12 cooperate in defining a closed chamber divided by the partition 26 in which a pair of shoes S or the like can be positively retained in separated relationship.

Figure 3:
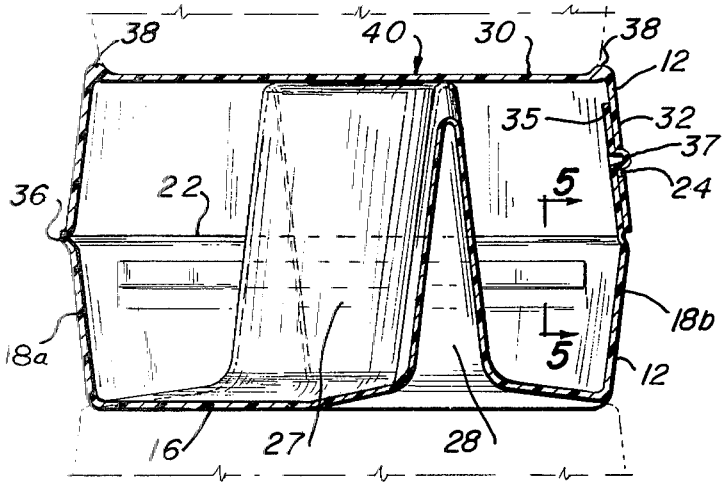
FIG. 3 is an enlarged vertical section taken along line 3—3 of FIG. 2 with a phantom line representation of boxes stacked above and beneath the illustrated box.
Figure 5:
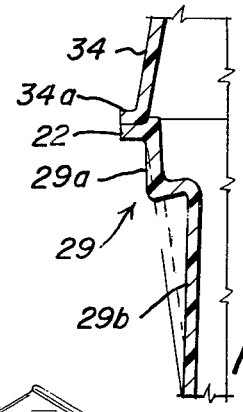
FIG. 5 is an enlarged vertical section taken along line 5—5 of FIG. 3 showing the latch for the box.

As best seen in FIG. 3, the top member 14 along both side edges of the top wall 30 is raised establishing ribs 38 therealong. The longitudinally extending ribs 38 define therebetween a recessed zone or seat 40 conforming in width to the width of the bottom of the receptacle 12 so that the boxes can be stacked in their closed condition in a positive manner. In other words, as shown in FIGS. 3 and 5, when a box is stacked on top of an underlying closed box, the bottom portion of the overlying box fits within the recessed zone 40 and is thereby prevented to a limited extent from being slid laterally relative to the underlying box. The recessed zone 40 thereby provides for positive stacking of the boxes and also assures that the boxes will be stacked in a perfectly vertical stack. The raised ribs 38 are not continuous around the perimeter of the top member 14 so that an overlying box can be slid relative to an underlying box in a longitudinal direction across the end walls 20*a* and 20*b* of the box to facilitate easy removal of a selected one of a plurality of boxes in a vertical stack. This allows a shoe salesman or the like to quickly and easily remove a selected box having the desired style and type of shoe therein from a stack of the boxes without materially disrupting the stack and so that a resulting stack is left in a perfectly vertical arrangement.

Preferably, the boxes 10 are made of an expanded polystyrene or polypropylene material which can be mass produced very inexpensively within limited tolerances. This makes the box very attractive from both the commercial and manufacturing standpoint. The advantages obtained from a shoe box of this type are innumerable since the boxes can be reliably stacked in very neat and orderly arrangements and can also be nested in compact stacks when not in use to avoid unsightly piles of disordered empty boxes. Further, since the top member or lid of the box is integrally connected to the receptacle portion or bottom of the box, the lids cannot be lost or separated from the remainder of the box. It will be appreciated that a box of uniform external dimensions can be varied internally to snugly receive most any size or style of shoe by varying the thickness of the partition and/or the corners and walls of the receptacle and/or top member.

Although the present invention has been described with a certain degree of particularity, it is understood that the present disclosure has been made by way of example and that changes in details of strcuture may be made without departing from the spirit thereof.

We claim:

1. A container for footwear comprising in combination:

an open topped receptacle having a bottom wall and side walls, said side walls being downwardly convergent whereby identical ones of said receptacles can be nested, a top member adapted to lie over the open top of the receptacle to selectively close the open top of the receptacle, and internal divider means in said receptacle adapted to separate respective ones of a pair of said footwear, said divider means opening downwardly through the bottom of the receptacle so as to pass through a generally S-shaped curve intersecting said opposite side walls at locations which are unequally spaced from adjacent side walls and thereby defining adjacent compartments in the receptacle of a size and configuration to approximate the size and configuration of a shoe.

2. The container of claim 1, wherein said partition has upwardly convergent side walls so that when a plurality of said receptacles are nested, said partitions will protrude into the partition of an overlying receptacle.

3. The container of claim 1, wherein said receptacle is of generally rectangular horizontal cross-section and has raised rims extending only along the side edges of the top member so that containers in stacked relationship can be easily slid longitudinally of each other, but the raised rims inhibit lateral sliding movement of the stacked containers.

4. The container of claim 1, wherein said top member is hingedly connected to the receptacle by a living hinge along one upper side edge of the receptacle.

5. The container of claim 4 wherein the upper side edge of the receptacle opposite from said one upper side edge and a portion of the top member having cooperating latch means to secure the box in a closed condition.

6. The container of claim 1 wherein the partition protrudes above the upper edge of the receptacle.

7. The container of claim 1 wherein said side walls at opposite ends of the receptacle protrude outwardly near the upper edge of the receptacle and said protrusions have means for facilitating manual gripping of the receptacle.

8. A container for footwear comprising in combination:

an opened topped receptacle having a bottom wall and side walls, internal divider means therein for at least partially separating respective ones of a pair of said footwear, said side walls being downwardly convergent and said divider means opening downwardly through the bottom of the receptacle whereby identical ones of said receptacles can be nested, and a top member adapted to lie over the open top of the receptacle to selectively close the open top of the receptacle, said side walls of the receptacle at opposite ends protruding outwardly near the upper edge of the receptacle with said protrusions having a lower portion which inclines upwardly and inwardly to facilitate manual gripping of the receptacle.

9. The container of claim 8 wherein said protrusions have a generally vertically extending portion and further including indicia on the vertically extending portion of at least one of said protrusions corresponding to material to be carried in the receptacle.

* * * * *